US005939980A

United States Patent [19]

Heitmann et al.

[11] Patent Number: 5,939,980

[45] Date of Patent: Aug. 17, 1999

[54] TELECOMMUNITY ALARM SYSTEM WITH A PLURALITY OF SECURITY SURVEILLANCE MODEMS

[75] Inventors: Gunter Heitmann, Hamburg; Andreas Albrecht, Norderstedt; Ralf Schulz, Henstedt-Ulzburg; Matthias Wendt, Kiel; Wolfgang Schumacher, Preetz, all of Germany

[73] Assignee: Deutsche Telekom AG, Bonn, Germany

[21] Appl. No.: 08/820,862

[22] Filed: Mar. 20, 1997

[30] Foreign Application Priority Data

Mar. 22, 1996 [DE] Germany ..... 196 11 271

[51] Int. Cl.[6] ..... G08B 29/00

[52] U.S. Cl. ..... 340/506; 340/531; 340/539; 340/533; 340/534; 379/37; 379/39; 379/40

[58] Field of Search ..... 379/44, 534, 531, 379/33, 37, 39, 40, 41; 340/538, 532, 533, 825.06, 825.69

[56] References Cited

U.S. PATENT DOCUMENTS 4,951,029 8/1990 Severson ..... 340/506

*Primary Examiner*—Jeffery A. Hofsass
*Assistant Examiner*—Daryl C. Pope
*Attorney, Agent, or Firm*—Kenyon & Kenyon

[57] ABSTRACT

A telecommunity alarm system having a plurality of security surveillance modems that can be connected to a telecommunication network via an analog or digital subscriber terminal port, the security surveillance modems forming a group of a predetermined size. The security surveillance modems each have a first memory for storing telephone numbers of the other modems in the group, a second memory for identifying the particular modem and a programmable control unit. The modems are designed to dial automatically, in the event of an alarm, the other security surveillance modems belonging to the group and signal the alarm status.

15 Claims, 2 Drawing Sheets

TELECOMMUNITY ALARM SYSTEM WITH A PLURALITY OF SECURITY SURVEILLANCE MODEMS

FIELD OF THE INVENTION

The invention relates generally to security systems, and more particularly to a telecommunity alarm system with a plurality of modems that can be connected to a telecommunications network.

RELATED TECHNOLOGY

Because of increasing crime rates, many people, especially the owners of single-family dwellings, find it necessary to secure their homes and premises with burglar alarm systems. The known burglar alarm systems are capable of signaling an intrusion visually and/or acoustically by means of sirens and warning lights. However, experience has shown that in many cases neighbors and passersby assume a false alarm when the system is triggered, or simply do not call the police, not the least of all because they are afraid of being blamed themselves. One solution is to connect such burglar alarms to a central alarm office that is manned at all hours. However, installation of such systems entails a considerable financial burden which prevents many people from acquiring such a burglar alarm.

SUMMARY OF THE INVENTION

Therefore, an object of the present invention is to provide a telecommunity alarm system and a security surveillance modem which is suitable for the system and with which efficient surveillance is possible, in particular surveillance of properties and buildings even without connecting the individual alarm systems to a permanently manned central office.

The present invention therefore provides a telecommunity alarm system with a plurality of security surveillance modems (10, 50, 60) that can be connected to a telecommunications network and form a group of a predetermined size, where each security surveillance modem (10, 50, 60) has the following features:

at least one input (90–93) to which a detector (20) for sensing an alarm status can be connected, a first memory (100) that can be programmed with the telephone numbers of the security surveillance modems belonging to the group, a second memory (110) containing a message to identify the security surveillance modem (10), and a programmable control unit (120) which automatically dials at least one of the telephone numbers entered in the first memory (100) in response to a signal supplied by the detector (20) and sends the identification message stored in the second memory (110) to the dialed security surveillance modem (50), where the programmable control unit (120) activates a device for output of an alarm signal and a display for displaying the identification message in response to a received identification message.

The present invention also provides a security surveillance modem for use in a telecommunity alarm system characterized by:

an interface (130) by means of which the security surveillance modem (10) can be connected to a telecommunications network, at least one input (90-93) to which a detector (20) for sensing an alarm status can be connected, a first memory (100) in which are entered the telephone numbers of those subscribers forming a group, a second memory (11) holding a message for identification of the security surveillance modem, and a programmable control unit (120) which, in response to a signal supplied by the detector (20), automatically dials at least one of the telephone numbers entered in the first memory (100) and sends the identification message contained in the second memory (110) to the subscriber (50) thus dialed, where the programmable control unit triggers a device for output of an alarm signal and a display device for displaying the identification message in response to an identification message received.

The invention is based on the idea of forming a telecommunity of informed and motivated neighbors who monitor each other's property. A telecommunity alarm system having a plurality of security surveillance modems is provided. Such a security surveillance modem is installed in the home of each member of the telecommunity and is connected to a telecommunications network via a digital or analog subscriber terminal port. Each security surveillance modem has at least one input terminal to which a detector can be connected to detect an alarm status. The detector is an alarm generator which can respond to the breaking of glass, the opening of a door, intrusion onto the premises and many other situations, and it can send a signal to the security surveillance modem. Each security surveillance modem has a first memory where the telephone number(s) of one or all members of the telecommunity can be stored. For example, up to ten different telephone numbers can be entered in the first memory. Another memory serves to store a message to identify the respective security surveillance modem. The identification message preferably includes the telephone number of the respective security surveillance modem and optionally the name and address of the subscriber where the security surveillance modem is installed. If the detector senses an alarm status, the corresponding security surveillance modem triggers an alarm in the home of at least one of the members of the telecommunity. In response to a signal supplied by the detector, a programmable control unit automatically dials one of the telephone numbers entered in the first memory and sends the identification message stored in the second memory to the security surveillance modem of the community member thus dialed. The programmable control unit is designed to trigger an acoustic and/or visual alarm signal in the home of the community member called in response to a received identification message and it outputs the identification message on a display. This ensures rapid and unambiguous identification of the security surveillance modem triggering the alarm.

To make the telecommunity alarm system more efficient, the programmable control unit automatically dials in a predetermined programmable sequence some or all of the telephone numbers entered in the first memory in response to the signal delivered by the detector.

A member of the community called by the alarm-triggering security surveillance modem confirms receipt of the identification message—for example, by pushing a button on his security surveillance modem. The programmable control unit then automatically initiates the establishment of a dial-up connection with the security surveillance modem sending the identification message, i.e., the modem triggering the alarm. At the same time, an acknowledgment signal is sent back.

To avoid keeping the other members of the community alerted for an unnecessarily long period of time, the programmable control unit of the alarm-triggering security surveillance modem automatically dials the programmed telephone numbers of the community members who have also been alerted in response to receipt of the acknowledgment signal and notifies them that the alarm has already been acknowledged. Each security surveillance modem may also have a third memory where an individual alarm message in text form, corresponding to the recognizable alarm status of the detector connected to the respective input terminal, can be stored for each input terminal. In the event of an alarm, the alarm message can be transmitted together with the identification message to the security surveillance modems of the other members of the community and output on a display there.

In addition, a fourth memory may also be provided to log all incoming and outgoing messages during a predetermined period of time.

With the present invention it is possible to efficiently monitor the properties and buildings of people who have joined together to form a telecommunity without having to connect the members of the telecommunity to a central alarm office.

BRIEF DESCRIPTION OF THE DRAWINGS

The invention is explained in greater detail below on the basis of one embodiment in conjunction with the accompanying figures, which show the following.

DETAILED DESCRIPTION

Figure 1:
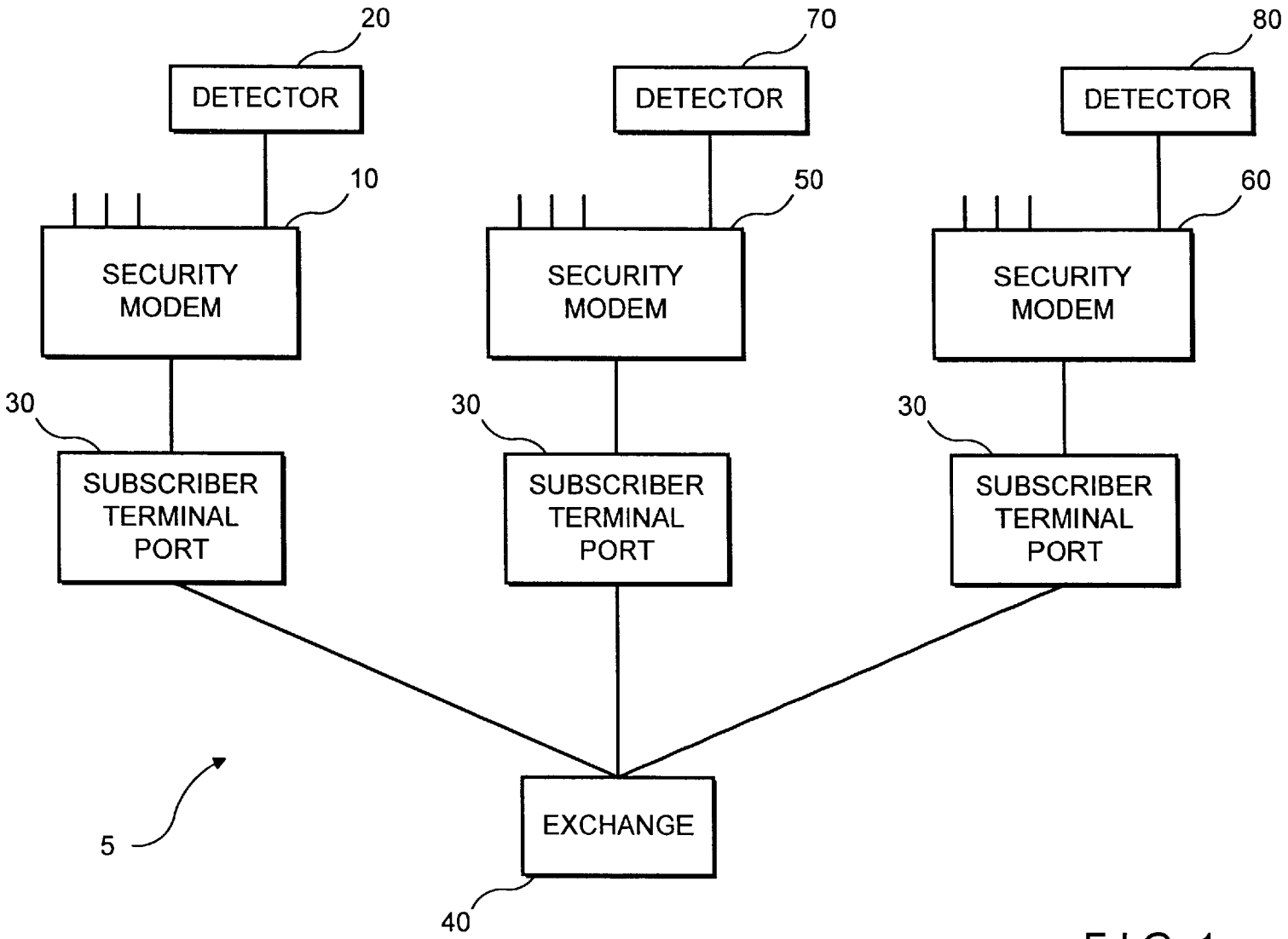
FIG. 1: a schematic diagram of a telecommunity alarm system according to this invention that can connect three security surveillance modems via an exchange.

FIG. 1 shows an example of a telecommunity alarm system, designated in general as 5, for three telecommunity members, hereinafter referred to as community members. Telecommunity alarm system 5 includes three security surveillance modems 10, 50 and 60 which are installed in three separate houses, for example. A certain physical proximity of the houses to each other is not necessary but would be convenient. Each security surveillance modem 10, 50 and 60 is connected to an exchange 40 of a telecommunication network via a subscriber terminal port, namely an analog TAE jack 30 in the present case. The security surveillance modems can of course also be connected to the telecommunication network via a digital connection unit. As FIG. 1 shows, only one detector or alarm generator 20, 70 or 80 is connected to each security surveillance modem 10, 50 and 60. The security surveillance modems are preferably designed for connecting up to four alarm generators. Of course, any desired number of alarm generators 20 may be connected as needed. Only one alarm generator 20, 70, 80 is connected to each security surveillance modem 10, 50 or 60 for the purpose of illustration only.

Figure 2:
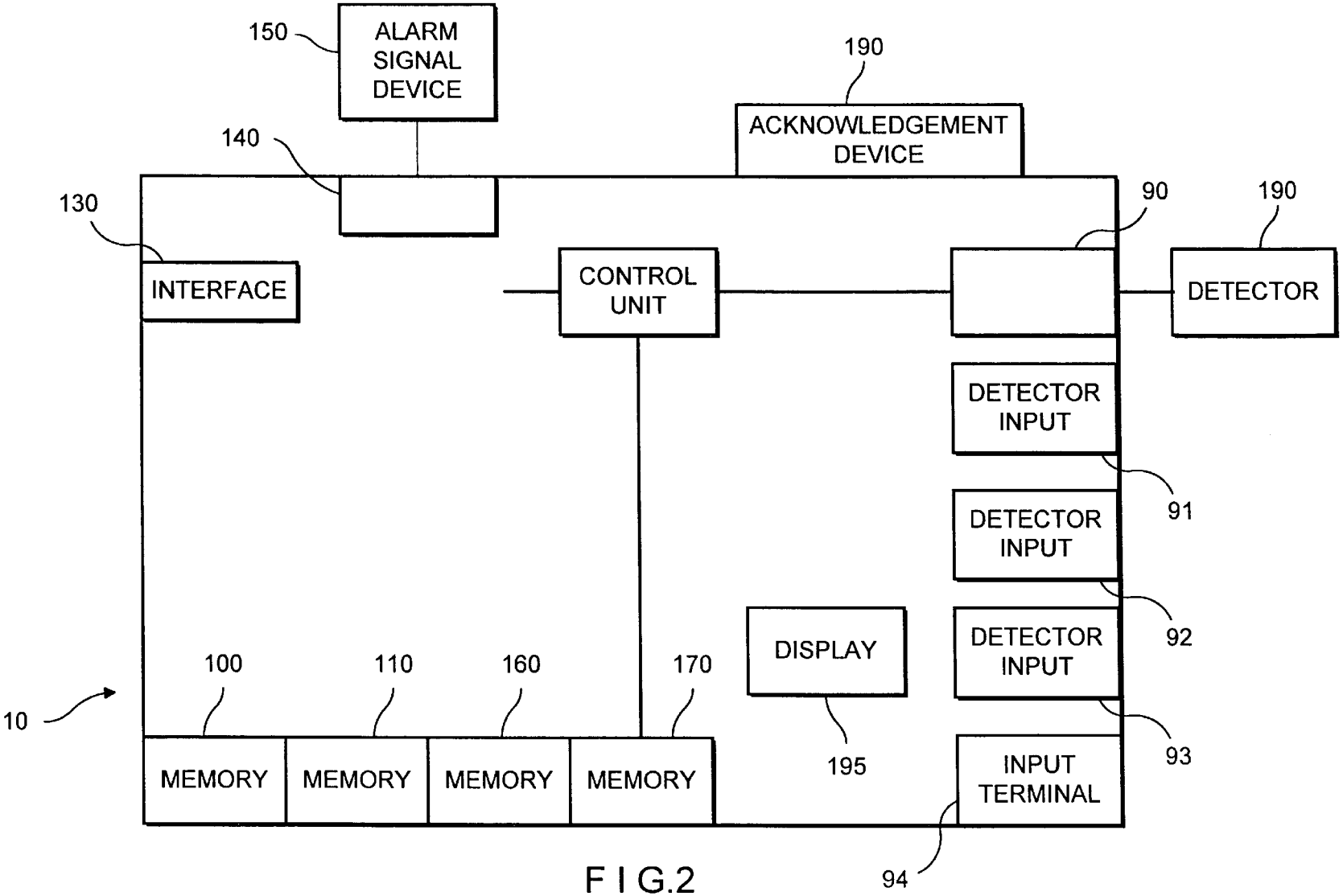
FIG. 2: a simplified block schematic of a security surveillance modem and suitable for use in the telecommunity alarm system according to FIG. 1.

FIG. 2 shows in simplified form the block diagram of security surveillance modem 10 illustrated in FIG. 1. It should be pointed out that all the security surveillance modems have essentially the same design. For example, security surveillance modem 10 here has four input terminals 90, 91, 92, 93, each of which may have one detector 20 or alarm generator connected to it. In the present case, only input terminal 90 has detector 20 connected to it. As explained in greater detail below, detector 20 serves to detect the breaking of glass, for example. Another input terminal 94 is for connecting a sabotage line with which, for example, detector 20 can be monitored so that security surveillance modem 10 can be protected against malicious tampering. An alarm signal device 150, in particular a siren or a warning light, is connected to output 140 and also may be connected to a programmable control unit 120. This device 150 can alert a telecommunity member of an alarm from another security surveillance modem, or also of malicious tampering. Security surveillance modem 10 has a first memory 100 where the telephone numbers of the two other security surveillance modems 50 and 60, i.e., the two other community members, are stored. A second memory 110 contains a message to identify security surveillance modem 10 or the community member. The identification message includes, for example, the telephone number of the community member where security surveillance modem 10 is installed. In addition, the identification message may also include the name and address of the respective community member. A third memory 160 may hold an individual alarm message in text form corresponding to the alarm status that can be detected by detector 20. Therefore, in the present example, the alarm message "glass broken" is stored in memory 160. If detectors are connected to the other input terminals 91 through 93, the corresponding individual alarm messages in text form can be stored in memory 160. Each alarm message stored in memory 160 is clearly assigned to one of input terminals 90–93. It should also be pointed out that all input terminals 90 through 94 can be programmed as either NO contacts or NC contacts. This means, for example, that detector 20, which is connected to input terminal 90 that is programmed as an NO contact, signals an alarm status if the loop monitored is interrupted due to the breaking of glass. In contrast with this, a detector connected to an input terminal programmed as an NC contact signals an alarm status when the monitored loop is closed. In a fourth memory 170 that serves as a protocol memory, all outgoing messages and all incoming messages arriving at security surveillance modem 10 within a predetermined period of time, preferably 24 hours, are recorded. Each security surveillance modem 10, 50, 60 may have an LCD display, a plurality of acoustic devices (e.g., an internal loudspeaker) and optical display devices (LEDs and lights to display the status), indicated generally at 195. An interface 130 is provided to permit connection of the modem 50 to a telecommunications network.

The operation of telecommunity alarm system 5 according to this invention is explained in greater detail below. For the sake of simplicity, let us assume that the telecommunity consists of three members, each of whom has a security surveillance modem 10, 50 or 60 installed in his home. In the present case, the name of the first member shall be F. Mueller, residing at 17 Garden Street. The second member shall be G. Stephan residing at 7 Goethe Street. The third member shall be A. Meier residing at 22 Garden Street. Let us also assume that security surveillance modem 10 is installed in the home of telecommunity member F. Mueller, security surveillance modem 50 is installed in the home of member G. Stephan and security surveillance modem 60 is installed in the home of member A. Meier. In the present example, it is assumed that detector 20 signaling that glass has been broken is connected only to input terminal 90. The system settings can be entered and each security surveillance modem can be programmed on site using a keyboard (not shown) or a terminal program on a computer that can be connected externally. The programming is preferably password protected. As explained in greater detail below, the programming of the security surveillance modem determines essentially to which of the input terminals 90 to 93 a detector is connected, how it behaves (as an NO or NC contact) and which telephone numbers are to be dialed in which order. For unambiguous identification of each security surveillance modem, the corresponding telephone number and optionally the area code may also be entered. Telecommunity member F. Mueller then programs his security surveillance modem 10 as follows: 1.) Input terminal 90 to which detector 20 is connected is programmed as an NO contact. 2.) The two telephone numbers of the other members of the telecommunity are entered into the first memory 100. For example, telephone number 555-2233 for member G. Stephan and number 555-4455 for the other member A. Meier are entered specifically in this order. 3.) F. Mueller enters his own telephone number 555-1166, his address (17 Garden Street in the present case) and/or his name in the second memory 110. 4.) The alarm message "glass broken" which is unambiguously assigned to input terminal 90 is entered in third memory 160. If the other input terminals 91 through 93 are also terminated with detectors, alarm messages corresponding to each alarm status (e.g., opening of a door or the presence of an intruder on the premises) of the respective detector can be stored in text form in memory 160. 5.) Using a key switch, F. Mueller has activated his security surveillance modem 10. Depending on the implementation, his security surveillance modem automatically performs an instrument check and displays any resulting error messages on the LCD display.

The second member G. Stephan enters telephone number 555-1166 for F. Mueller and number 555-4455 for member A. Meier in the first memory 100 of his security surveillance modem 50. It is not necessary to enter an area code because the members of this community all live in the same area. Second memory 110 of security surveillance modem 50 contains, for example, the name G. Stephan, his telephone number 555-2233 and his address 7 Goethe Street. Third memory 160 may contain in text form alarm messages corresponding to whichever detectors are connected.

A. Meier, the third member of the telecommunity, programs his security surveillance modem 60 so that the first memory 100 contains telephone number 555-1166 of the member F. Mueller and telephone number 555-2233 of the other member G. Stephan. Second memory 110 contains Meier's own identification message, i.e., the name A. Meier, his telephone number 4455 and his address, i.e., 22 Garden Street. Third memory 160 can be programmed with the corresponding alarm messages in text form. Let us now imagine the following scenario: an intruder has broken a window pane in the residence of member F. Mueller. Then siren 150 or an alarm light is activated, thus signaling a break-in acoustically or visually. At the same time, detector 20 notifies control unit 120 that glass has been broken. Control unit 120 is programmed to automatically dial the two telephone numbers of the other telecommunity members entered into memory 100 in the order given, i.e., first number 555-2233 and then number 555-4455. In other words, after detector 20 signals that glass has been broken, security surveillance modem 10 immediately establishes a dial-up connection with security surveillance modem 50. After establishing the dial-up connection, control unit 120 assures that the identification message (including the name F. Mueller, telephone number 555-1166 and 17 Garden Street) entered into memory 110 together with the alarm message "glass broken" entered in memory 160 are transmitted to security surveillance modem 50. A loudspeaker in security surveillance modem 50 alarms telecommunity member G. Stephan that there has been a break-in in the home of one of the telecommunity members. Furthermore, at the same time or immediately thereafter, an LCD display shows the identification message "F. Mueller, 17 Garden Street, telephone number 555-1166" as well as the alarm message "glass broken." Then security surveillance modem 10 dials the second telephone number 555-4455 in memory 100, which is the number of telecommunity member A. Meier. Once the dial-up connection has been established, the identification message in memory 110 and the alarm message stored in memory 160 are in turn transmitted to security surveillance modem 60. Here again, there is an acoustic and/or visual alarm message, and the identification message and the alarm message of security surveillance modem 10 triggering the alarm are displayed. Let us assume that member G. Stephan is the first to notice the alarm triggered by security surveillance modem 10 and confirms the alarm immediately. To do so, he can press a certain button 190 (or other acknowledgment device) on his security surveillance modem 50. In response to his depressing the button, security surveillance modem 50 automatically dials the telephone number 555-1166 of security surveillance modem 10 triggering the alarm, and as soon as a dial-up connection has been established, modem 50 transmits an acknowledgment message to security surveillance modem 10. However, if the attempt by security surveillance modem 50 to acknowledge the alarm message fails, the message "subscriber not reached" will appear on the LCD display. For example, this may be the case if member A. Meier has first confirmed the alarm message on his security surveillance modem 60 and thus the line to security surveillance modem 10 is already busy.

After receiving the acknowledgment message from security surveillance modem 50, security surveillance modem 10 dials the telephone number 555-4455 of security surveillance modem 60, which has been alerted by security surveillance modem 10 but has not yet sent back confirmation of the alarm message. After establishing the dial-up connection, security surveillance modem 10 transmits the message "alarm acknowledged" to security surveillance modem 60. After member G. Stephan has been informed of the break-in at F. Mueller's, he can take required measures, such as notifying the police. After security surveillance modem 10 has transmitted the "all-clear" message to security surveillance modem 60, it automatically returns to a state of readiness. The procedure described above is carried out again in the event another alarm is detected by detector 20.

It is superfluous to point out that the procedure described above can take place only if security surveillance modems 10, 50 and 60 that are connected to the telecommunications network have in fact also been activated. "Connected" as used herein can either direct or indirect, and may, for example, include direct electrical connections and/or infrared connections. A component of the telecommunity alarm system can comprise a security surveillance modem and its corresponding alarm detectors and signal devices.

What is claimed is:

1. A telecommunity alarm system including a plurality of security surveillance modems which can be connected to a telecommunications network to form a group of predetermined size, each security surveillance modem comprising:

at least one input to which a detector for sensing an alarm status can be connected;

a first memory capable of being programmed with telephone numbers of other security surveillance modems of the group;

a second memory containing an identification message identifying the security surveillance modem; and a programmable control unit connected to the first memory and second memory and to a telephone system, the programmable control unit for automatically dialing at least one of the telephone numbers entered in the first memory in response to an alarm signal supplied by the detector and for sending the identification message stored in the second memory to another security surveillance modem of the group, the programmable control unit connected to an alarm signal device and to a display for displaying a received identification message.

2. The telecommunity alarm system as recited in claim 1 wherein the first memory stores the telephone numbers, and after receiving the alarm signal, the programmable control device dials all the telephone numbers in the predetermined sequence.

3. The telecommunity alarm system as recited in claim 1 wherein each security surveillance modem further comprises an acknowledgment device so that when the security surveillance modem receives the received identification message and an operator activates the acknowledgment device, the programmable control unit initiates automatically a dial-up connection with the security surveillance modem that sent the received identification message and sends an acknowledgment signal.

4. The telecommunity alarm system as recited in claim 3 wherein the programmable control unit of the security surveillance modem that sent the received identification message, in response to the receipt of the acknowledgment signal, dials telephone numbers of the other security surveillance modems of the group and signals that the alarm has been acknowledged.

5. The telecommunity alarm system as recited in claim 1 wherein the identification message of each security surveillance modem includes the respective telephone number, address and/or name of a group subscriber.

6. A security surveillance modem for use in an alarm system for a telecommunity comprising:

an interface for connecting the security surveillance modem to a telecommunications network;

at least one input to which a detector for sensing an alarm status can be connected;

a first memory for storing telephone numbers of the telecommunity;

a second memory for storing an identification message for identification of the security surveillance modem; and a programmable control unit connected to the first memory and second memory which, in response to a signal supplied by the detector, automatically dials at least one of the telephone numbers entered in the first memory and sends the identification message contained in the second memory, the programmable control unit also connected to a device for output of an alarm signal and to a display device for displaying another identification message in response to a received identification message.

7. The security surveillance modem as recited in claim 6 wherein the telephone numbers stored in the first memory are stored in a predetermined sequence.

8. The security surveillance modem as recited in claim 6 further comprising an acknowledgment device.

9. The security surveillance modem as recited in claim 6 further comprising optical and/or acoustic alarm and/or status display devices.

10. The security surveillance modem as recited in claim 6 further comprising at least one output to which an alarm signal device can be connected.

11. The security surveillance modem as recited in claim 6 wherein there are four inputs, each of which may have a detector connected to it, and further comprising another input for monitoring a sabotage line.

12. The security surveillance modem as recited in claim 6 further comprising a third memory for storing an individual alarm message in text form, the individual alarm message corresponding to each of the at least one input.

13. The security surveillance modem as recited in claim 6 further comprising an attachment for a keyboard, wherein data can be entered and the security surveillance modem can be programmed through the keyboard.

14. The security surveillance modem as recited in claim 13 wherein the data is password protected.

15. The security surveillance modem as recited in claim 6 further comprising a fourth memory for recording all incoming and outgoing messages within a predetermined period of time.

* * * * *

UNITED STATES PATENT AND TRADEMARK OFFICE

CERTIFICATE OF CORRECTION

PATENT No. : 5,939,980

DATED : August 17, 1999

INVENTOR(S): Gunter Heitmann, Andreas Albrecht, Ralf Schultz, Matthias Wendt, Wolfgang Schumacher

It is certified that error appears in the above-identified patent and that said Letters Patent is hereby corrected as shown below:

Column 5, line 45, "4455" should be changed to -- 555-4455 -- ;

Column 6, line 51, "can either" should be changed to -- can be either --.

Signed and Sealed this

Twentieth Day of June, 2000

*Attest:*

Q. TODD DICKINSON

*Attesting Officer*

*Director of Patents and Trademarks*